United States Patent [19]

Darling

[11] Patent Number: 4,560,164

[45] Date of Patent: Dec. 24, 1985

[54] TOY PUZZLE

[76] Inventor: Phillip H. Darling, 8866 Tulare Dr. 301H, Huntington Beach, Calif. 92646

[21] Appl. No.: 620,137

[22] Filed: Jun. 13, 1984

[51] Int. Cl.[4] ..... A63F 9/08

[52] U.S. Cl. ..... 273/155; 70/289; 70/299; 434/123; 434/124

[58] Field of Search ..... 273/153 R, 155; 70/289, 70/297, 298, 299, 300, 311; 434/123, 124

[56] References Cited

U.S. PATENT DOCUMENTS

| | | | |
|---|---|---|---|
| 1,308,090 | 7/1919 | Markley | 70/299 |
| 3,128,100 | 4/1964 | Sinden | 273/155 UX |
| 3,659,854 | 5/1972 | Sinden | 273/155 |
| 3,719,064 | 3/1973 | Potzick | 70/299 |

FOREIGN PATENT DOCUMENTS

| | | | |
|---|---|---|---|
| 724131 | 2/1955 | United Kingdom | 273/155 |

*Primary Examiner*—Anton O. Oechsle

*Attorney, Agent, or Firm*—Knobbe, Martens, Olson & Bear

[57] ABSTRACT

In a tubular toy puzzle, the object is to manipulate indicia on rotatable rings to achieve a desired arrangement of the indicia. Manipulation occurs by rotating a drive mechanism connected with a combination of the rings. Axial repositioning of a drive shaft in the drive mechanism changes the combination of rings which can be manipulated.

17 Claims, 13 Drawing Figures

10
18
56
40
44
46
20
16
48
48a
48b
48c
48d
48e
48f
42
50
58
6
52
60
66
68
70
72
74

Fig. 4
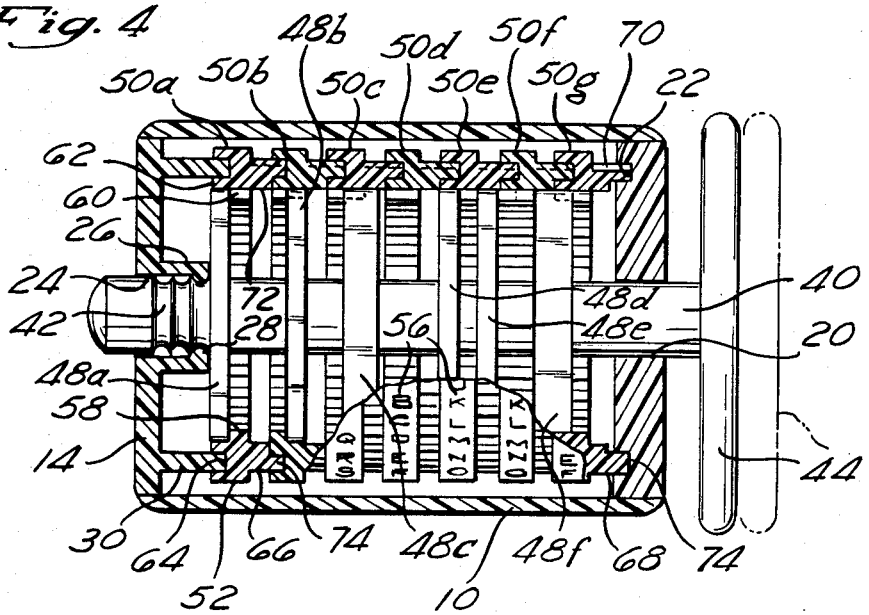
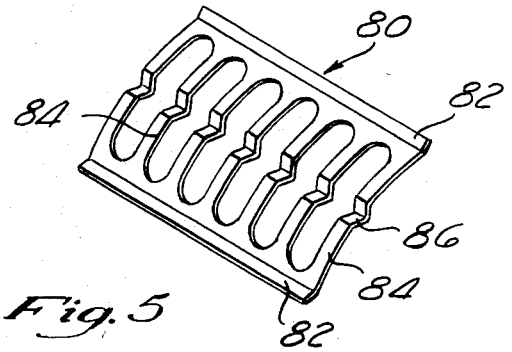
Fig. 5
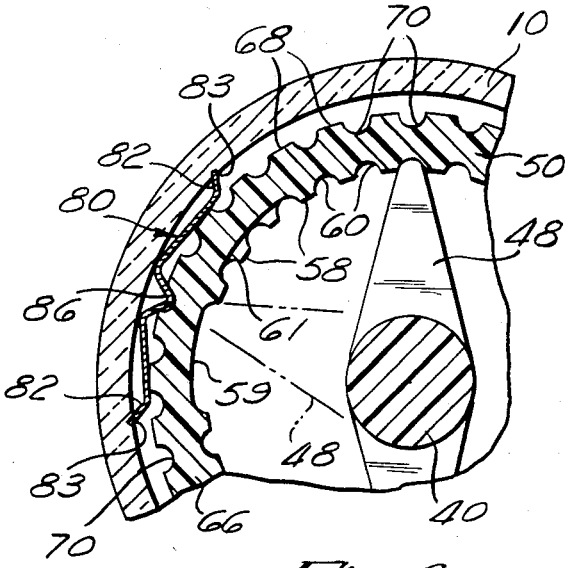
Fig. 6
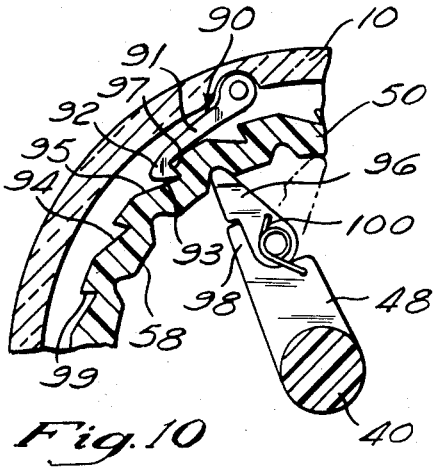
Fig. 10

Fig. 7
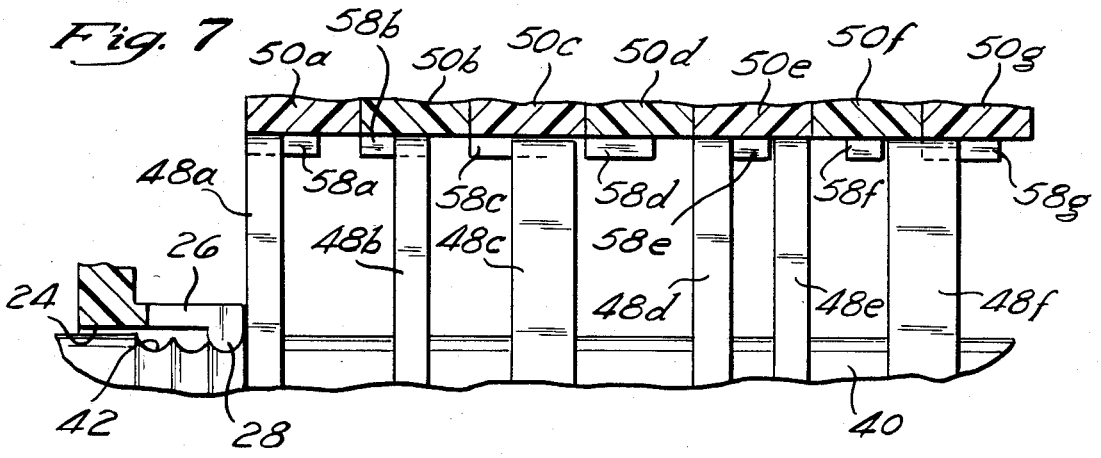
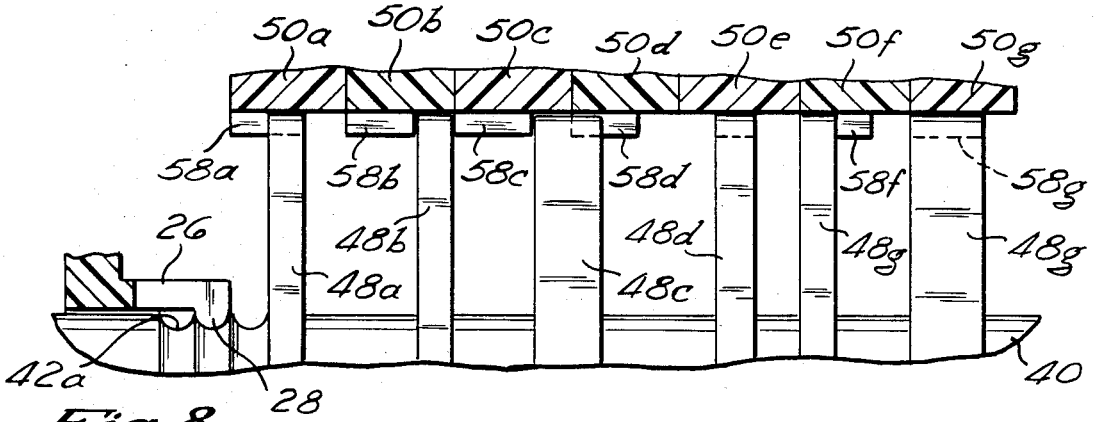
Fig. 8
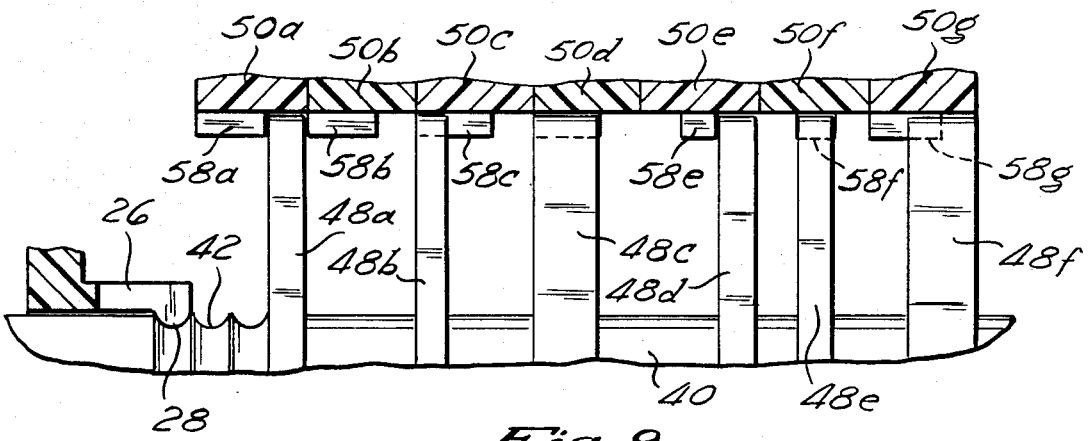
Fig. 9

TOY PUZZLE

BACKGROUND OF THE INVENTION

This invention relates generally to cryptographic devices, and in particular to a tubular, puzzle type of cryptographic device.

There are a number of puzzle type devices, one recently popular one being that sold under the registered trademark Rubik's Cube. Rubik's Cube can be thought of as a cube having different colors on each of the cube faces, each face being composed of a number of smaller cubes which are mechanically connected to allow rotation and translation of various sets of cubes. By manipulation of the various sets of cubes, different color patterns can be arranged on each face of the cube.

A similar puzzle is one wherein a number of squares are placed in a planar, rectangular frame, each of the squares having interlocking tongue and groove connections to allow two dimensional translation of each square within the frame. Numbers, letters or other indicia are placed on the exposed surface of the squares so that various rearrangements of the squares produce changes in the overall appearance of the squares.

The goal in the above puzzles is to start at a given, or random orientation of the puzzle, and to manipulate it until a predetermined orientation or arrangement of parts is obtained. This type of puzzle can be used as a cryptographic device by starting with a predetermined arrangement, manipulating the puzzle through a known or given set of manipulations, and then reading the encrypted or deciphered message from the rearranged elements. In puzzles and cryptographic devices of this type, it is desirable to have as many variations and as much complexity as possible since it makes the puzzle more challenging to solve, the message more difficult to decipher.

The prior art devices and puzzles had fixed, or unchangeable connections among the various elements. These fixed connections limited the number of variations which could occur in positioning or rearranging the various sub-elements, thereby limiting the difficulty of solving the puzzle. One object of this invention is to provide a means of varying the connection among the various sub-elements of a cryptographic device so as to increase the variations which can occur in rearranging the various sub-elements.

SUMMARY OF THE INVENTION

Simply described, the invention consists of a toy, hand held puzzle whose object is to rearrange several moveable segments so that indicia on a visible surface of those sections forms a desired arrangement. In one form of this puzzle, the moveable segments are rotatable rings, with symbols or letters on the outer surface of the rings. Rotating the rings allows rearrangement of the indicia to achieve the desired arrangement of the indicia behind a stationary window.

A drive mechanism is provided so that the moveable segments can be manipulated by hand, but only through the drive mechanism. The drive mechanism allows the introduction of varying degrees of complexity or difficulty into the device of this invention. One form of this drive mechanism consists of a drive member having a plurality of gears or projections which engage the moveable segments in order to transmit motion to those segments. Rotation of the drive member would cause motion of the engaged moveable segments. If the moveable segments take the form of the rings previously described, then the projections engage with a corresponding engaging surface on the inner diameter of the rings in order to rotate those rings which are engaged with the projections.

Rearrangement of the indicia is made more challenging by interconnecting the movement of various combinations of segments, and by providing a mechanism by which various predetermined combinations of segments can be selected. In other words, the puzzle is more challenging if the positioning of one moveable segment into the desired arrangement causes a plurality of other segments to move in a manner which would inhibit achievement of the desired arrangement of indicia. To vary the combinations of segments which are moved, a mechanism is provided to vary the combination of segments which are engaged and driven by the drive mechanism.

One way of changing the combination of moveable segments which are engaged with the drive mechanism is to reposition one element in the drive mechanism so that the drive mechanism engages and moves a different combination of moveable segments. One way of achieving this repositioning is to axially reposition a drive member by hand so that the projections or gears on the drive member engage a different combination of moveable segments. This repositioning advantageously allows a plurality of combinations of moveable segments to be engaged, thereby introducing large degrees of complexity and difficulty to the manipulation of the indicia to achieve the desired arrangement.

A housing supports the drive mechanism and the moveable segments. If the housing conceals the drive mechanism so that the person manipulating the puzzle cannot see how the mechanism functions, then the complexity of the puzzle is further increased. On the other hand, a housing which exposes the drive mechanism can be educational in demonstrating how such mechanisms function. The moveable segments can be nested against one another so that they mutually support one another within the housing. This nesting advantageously allows a compact and lightweight structure with relatively few parts.

An indexing member can be used to insure alignment of the moveable segments with the drive mechanism and inhibit inadvertent movement of the segments. This alignment facilitates the repositioning of elements in the drive mechanism, such as the projections on the drive member, which repositioning alters the combination of segments which are to be moved or manipulated. The indexing member can take the form of a lever urged into a detent on the moveable segments so as to stop movement of the segments in predetermined positions to aid in alignment of the projections and engaging members. The indexing member is connected to the housing to resist travel of the moveable segments relative to the housing. There is thus advantageously provided an efficient means of aligning the elements in the drive mechanism to facilitate repositioning of the elements in the drive mechanism.

Arranging the indicia can be made even more difficult or challenging by providing for intermittent movement of one or more of the moveable segments. This intermittent movement can be achieved by intermittently disengaging the drive mechanism from at least one of the moveable segments. For example, the projections on the drive member, which were previously mentioned, could engage with mating engaging members on the moveable segments. Omitting a portion of the engaging members on the moveable segments would temporarily disengage the drive mechanism from the moveable segments as the projections traverse the omitted portion and reengage the engaging members to again cause movement of the segments, thereby causing intermittent movement of the segment. This intermittent motion advantageously provides an additional variable in manipulating the device to re-orient the indicia on the moveable segments, thereby advantageously providing a more challenging and complex puzzle or cryptographic device.

It is also possible to place unidirectional travel limits on various moveable segments in order to limit particular segments to movement in only one direction, as by pawl and ratchet devices. Similarly, the projections on the drive member can be designed to cause movement in only one direction by designing the projections to exert a moving force in only one direction by conventional ratchet means, or by pivoting the engaging portion of the projection and using a unidirectional rotational stop to limit motion to one direction. These aspects advantageously make the rearrangement of the indicia more complex and difficult for the manipulator to achieve, yet relatively few parts are needed to provide these advantages.

DESCRIPTION OF THE DRAWINGS

FIG. 4 is a partial cross-sectional view taken along the axial diameter of FIG. 1;

FIG. 5 is a perspective view of the spring indexing device of this invention;

FIG. 6 is a partial cross-sectional view taken along 6—6 of FIG. 2 of this invention;

FIG. 7 is a partial section taken along the axial diameter of FIG. 1, showing a first engagement of the moveable segments and drive mechanism;

FIG. 8 is a partial section taken along the axial diameter of FIG. 1, showing a second engagement of the moveable segments and drive mechanism;

FIG. 9 is a partial section taken along the axial diameter of FIG. 1, showing a third engagement of the moveable segments and drive mechanism;

FIG. 10 is an illustration of a pawl and ratchet mechanism, and also shows a pivoted drive member with a unidirectional rotational stop;

DETAILED DESCRIPTION OF THE PREFERRED EMBODIMENT

Figures 1, 2, 3:
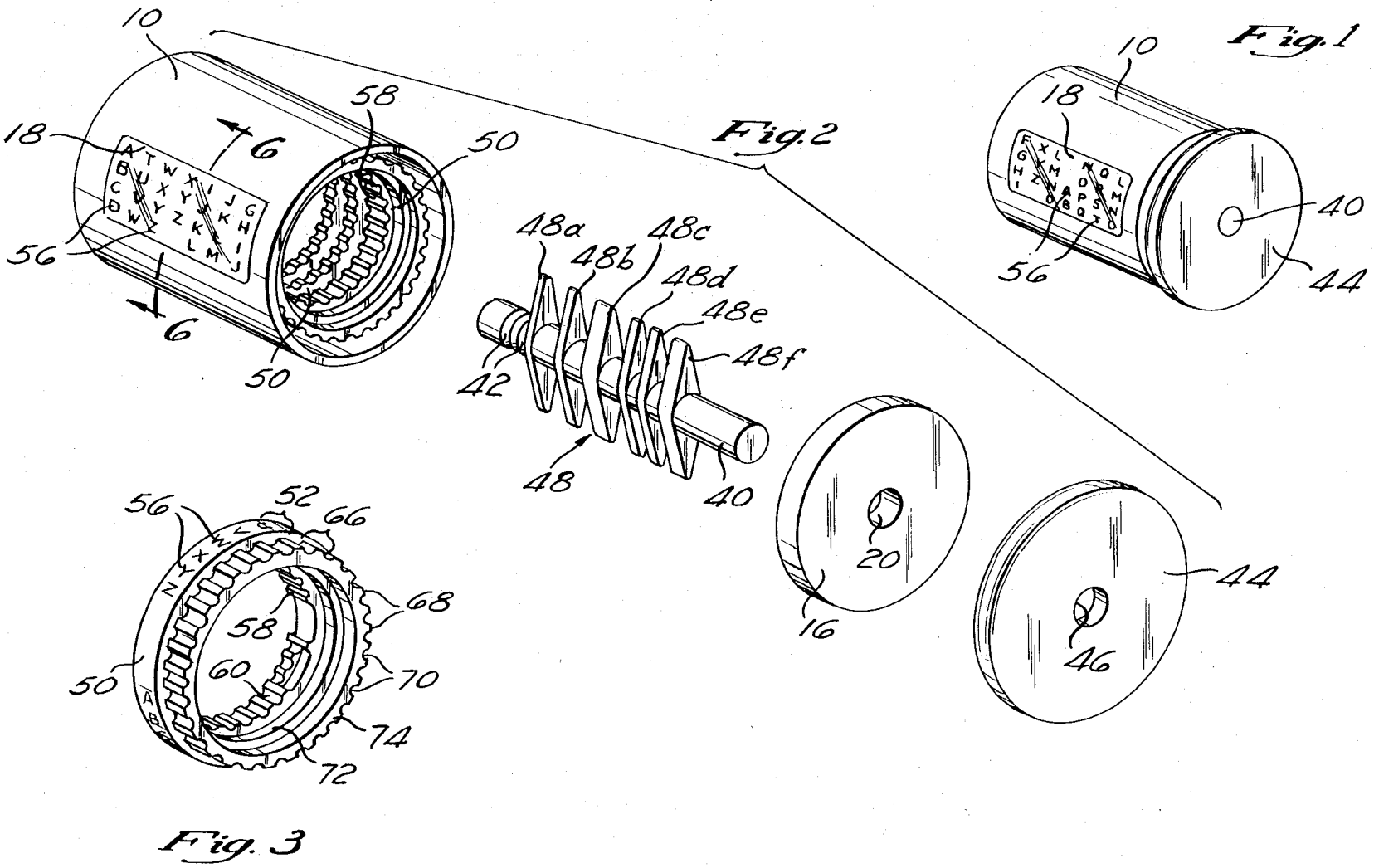
FIG. 1 is a perspective view of the device of this invention.
FIG. 2 is a partially exploded perspective view of this invention.
FIG. 3 is a perspective view of one of the moveable segments of this invention.

Referring to FIG. 1, there is shown the tubular puzzle or cryptographic device of this invention. There is a tubular housing 10 having an opening or window 18 through which the plural letters or indicia 56 can be perceived or viewed. The indicia 56 are connected to a plurality of mutually positionable elements. The device is small enough to be held and manipulated by hand so that rotation of a handle 44 causes rearrangement of various subsets of mutually positionable elements and of the indicia 56. The object of the device of this invention is to manipulate the device to obtain a predetermined arrangement or operative location of incremental portions, or indicia 56, such that the indicia 56 achieve a desired mutual relationship.

FIGS. 2 and 3 illustrate the manner in which the handle 44 enables a person to manipulate the driver elements, or indicia 56 by use of driving elements such as an intermediate drive or drive mechanism. A plurality of moveable elements, segments, or stepped rings 50 are rotatably mounted inside of the cylindrical housing 10. The stepped rings 50 have the indicia 56 on an external, visible surface. Engaging members 58 are located on an interior surface of the stepped rings 50. A rotatable drive member 40 having radial projections 48, is inserted into housing 10 so that the projections 48 engage with the engaging members 58 on the stepped rings 50. Rotation of drive member 40 causes rotation of projections 48 which engage with engaging members 58 on stepped ring 50 to cause rotation of ring 50 and thereby reposition the indicia 56 which are visible through window 18 on housing 10.

Cylindrical housing 10 has an end piece 16 at one end of the cylinder. The drive member 40 is inserted through an aperture 20 in the end piece 16, and projects beyond end piece 16. Thus, the end piece 16 serves to rotatably support one end of drive member 40. The handle 44 has aperture 46 which fits over and fastens to the end of drive member 40 which projects through end piece 61. Thus, a person can manipulate the indicia 56 by rotating the handle 44 to cause rotation of drive member 40, projections 48, and stepped rings 50.

The projections 48 are usually fewer in number than the stepped rings 50. The projections 48 are also not uniformly spaced along the length of drive member 40. Thus the projections 48 engage a combination of some, but not all, of the stepped rings 50. By applying hand pressure to handle 44, the drive member 40 can be axially repositioned so that the projections 48 engage a different combination of stepped rings 50, thereby enabling rearrangement of a different combination of indicia 56 when handle 44 is rotated. Thus, diverse axial positioning and rotation of drive member 40 through handle 44 allows a person to manipulate the arrangement of indicia 56 in order to achieve varying arrangements of indicia 56.

A more detailed description of the device of this invention follows. Referring to FIG. 1, the housing 10 can be of diverse shapes but is preferably cylindrical. The window 18 is located in housing 10. The window 18 can be of diverse shape and location, but is preferably rectangular, and located as to enable viewing of some or all of indicia 56. Referring to FIG. 4, there is shown a circular disk, or end piece 14 which covers one end of cylindrical housing 10, while another circular disk, or end piece 16 covers the other end of the cylindrical housing 10. The shape of end pieces 14 and 16 will vary with the shape of housing 10.

The end piece 16 has an aperture, or a circular hole 20 through the center of its circular shape, coaxial with the longitudinal axis of cylindrical housing 10. Located on the internal side of end piece 16, and preferably toward the outer periphery, is a support element, or aperture, shown as a circular groove 22, which is rectangular in section. This groove 22 helps to support the stepped rings 50 in a manner to be subsequently described.

At the center of end piece 14, and coinciding with the location of the longitudinal axis of housing 10, is an aperture or hole 24. Hole 24 is bounded by a resilient support structure which can take the form of members or struts, but is preferably a tubular structure such as cylindrical flange 26. The flange 26 extends axially inward from end piece 14 and has a protrusion such as rounded rib 28 projecting radially inward to define the minimum diameter of hole 24. The flange 26 and rib 28 may be slotted to more readily allow radially outward deflection of rib 28. This support structure supports one end of drive member 40 and allows for axial repositioning of member 40 in a manner to be subsequently described.

Located on the internal side of end piece 14, toward the periphery thereof, is an inwardly protruding support element or structure, which can take the form of members or struts, but is preferably an intermittent or continuous support ring 30 which forms a cylinder extending inward of end piece 14 and concentric with the longitudinal axis of housing 10. This support ring 30 helps to support the stepped rings 50 in a manner to be subsequently described.

A more detailed view of the drive mechanism is shown in FIGS. 2 and 4, where there is shown a drive member or drive shaft 40, which is preferably a cylindrical shaft. Near one end of drive shaft 40 are a number of recesses or detents, which preferably take the form of circumferential, annular grooves 42. Three grooves are shown for the illustrated embodiment. At the other end of drive shaft 40 are means for transferring rotation and translation to the drive shaft 40, such as a crank or handle, which means preferably takes the form of a circular disk which acts as the handle 44. Drive shaft 40 is inserted and fastened into hole 46 which is located at the center of the handle 44 so as to connect the handle 44 to the shaft 40. This connection allows the user to rotate handle 44 and thereby rotate drive shaft 40.

Intermediate the annular grooves 42 and the handle 44, and within housing 10, are mounted a plurality of drive elements such as gears, but which preferably take the from of a simplified, two-tooth gear, such as projections 48. The projections 48 are mounted to, and preferably extend radially from, drive shaft 40. Each of projections 48 has a diamond shape such that when the drive shaft 40 is placed through the center of the diamond, there result two generally triangular segments emanating from the drive shaft 40 in radially opposing directions. As shown in the figures, there are six projections 48*a*–*f* in the illustrated embodiment. The projections 48 need not be uniformly spaced along the length of drive shaft 40. Counting from left to right, the third and sixth projections 48*c* and 48*f*, are approximately twice the width of the other projections, and the sixth projection 48*f* is located nearest the handle 44. The projections 48 drive the stepped rings 50. The differing widths of the projections 48 enables the engagement of different combinations of stepped rings 50 in a manner to be subsequently described.

As shown in FIG. 4, drive shaft 40 is rotatably supported on one end by end piece 14 which has rounded rib 28 in contact with one of annular grooves 42 on drive shaft 40, the shaft 40 extending outside the hole 24 formed by rib 28. The other end of drive shaft 40 extends through hole 20 in end piece 16 and is rotatably supported by end piece 16. End pieces 14 and 16 support drive shaft 40 in such a manner that drive shaft 40 can not only rotate, but can translate axially if sufficient axial translation force is exerted to cause rounded rib 28 to deflect out of one annular groove 42 and into an adjacent groove 42. The flange 26 supporting rounded rib 28 acts like a spring detent to resiliently urge the rib 28 into one of the annular grooves 42, and further acts to resiliently resist translation by urging or biasing the rib 28 into the detent or groove 42.

The axial translation of drive shaft 40 causes translation of projections 48 which are mounted on shaft 40. If the projections 48 are moved a sufficient distance, they disengage one combination of stepped rings 50 and engage a different combination of rings. There is thus advantageously provided an efficient support for the drive mechanism which allows repositioning of at least one drive element of that mechanism. One further advantage of this invention is that it uses a direct drive train in which elements of the drive train such as projections 48 are removably engaged to change the combination of the members which are driven.

A more detailed description of the stepped rings 50 can be provided by referring to FIGS. 3 and 4. The indicia 56 are located on the moveable segments which can be linearly translating or rotational, but are preferably rotational and have the form of an annular stepped ring 50. Briefly described, the outer surface of stepped ring 50 has one reduced diameter or stepped section. The inner surface of stepped ring 50 has three consecutively larger diameters as would form a three-stepped, expanding, inner diameter. Alternately phrased, the inside diameter appears as if there are three consecutive rings of decreasing inside diameter. The outside appears as if there are two consecutive rings of increasing outside diameter. There is a circular groove 64 (FIG. 4) of rectangular cross section in one end of the stepped ring 50.

The first stepped portion 52 of stepped ring 50 has a surface, which is preferably the outside or external surface, on which numbers, letters, symbols, colors, or other indicia 56 are located. The inside diameter of the first stepped portion 52 of stepped ring 50 has the smallest inner diameter of stepped ring 50, and has an engaging portion with engaging members such as engaging teeth 58 which have recesses or slots 60 between the teeth 58. The engaging teeth 58 can be of diverse form such as helical or spur gear teeth, but are preferably formed as lands between repeated semi-cylindrical grooves or slots 60. The engaging teeth 58 and slots 60 are preferably oriented parallel to the longitudinal axis of stepped ring 50. The projections 48 engage with the engaging teeth 58 in order to rotate the stepped rings 50.

A support element is located on one surface of stepped ring 50, preferably the end 62 of first stepped portion 52 (FIG. 4). In the preferred embodiment, the support element takes the form of an aperture which can be of diverse shape, size and number, but which preferably corresponds to the shape of the support structure whose preferred embodiment is support ring 30. The aperture thus is preferably a circumferential, rectangular groove 64 which is co-axial with the longitudinal axis of stepped ring 50. Support ring 30 thus mates with rectangular groove 64 on stepped ring 50 in order to support that ring 50. This support allows rotation of stepped ring 50.

On the end of the first stepped portion 52 opposite end 62 is located a second stepped portion 66 on stepped ring 50. The second stepped portion 66 is an annular ring having indexing means on one surface. The indexing means maintains the alignment of non-driven rings 50 and helps align the engaging teeth 58 so that the projections 48 can slide between the engaging teeth 58 on adjacent stepped rings 50 in order to engage different combinations of stepped rings 50. The alignment is described later in the specification. The indexing means can take the form of recesses, notches, projections, or a combination thereof, but are preferably projections, or indexing teeth 68, with indexing apertures, recesses, detents or slots 70 located intermediate the indexing teeth 68. Both the teeth 68 and the slots 70 are preferably located on an external surface of the second stepped portion 66. The slots 70 are preferably oriented with their length along the length of a cylinder having a longitudinal axis coincident with that of stepped ring 50.

The inside diameter or internal surface 72 of second stepped portion 66 has a larger diameter than that of the cylinder encompassing slots 60 on the first stepped portion 52, so as to form a stepped ring which has a radially expanding, stepped diameter on the inside of the stepped ring 50. As will be described in more detail later, this internal surface 72 provides a space or gap between adjacent stepped rings 50 so that a projection 48 positioned in that gap does not engage a stepped ring 50.

In the illustrated embodiment there is a third stepped portion 74 adjacent the second stepped portion 66. Stepped portion 74 acts as an engaging and support element or member. This support member could take diverse forms such as struts or curved supports, which mate with the corresponding support elements on adjacent moveable segments or support structure. In the preferred embodiment the support member is a tubular or cylindrical projection, as will mate with either the rectangular groove 64 or the groove 22. Thus the groove 22 in end piece 16 can rotatably support a mating stepped ring 50.

The third stepped portion 74 has a larger inside diameter than either that of internal surface 72 or the cylindrical surface passing through slots 60 on the first stepped portion 52. Thus, stepped ring 50 has three internal steps which are radially expanding, with the smallest stepped ring containing the teeth 58 and slots 60, the intermediate ring containing the internal surface 72, and the third and largest internal ring containing third stepped portion 74. The outer diameter of the stepped ring 50 only has two steps, the first stepped portion 52 substantially corresponding with engaging teeth 58 on the inner diameter. The second step of the outer diameter contains the indexing teeth 68, the axial length of indexing teeth 68 substantially corresponding to the combined axial length of the internal surface 72 and the third stepped portion 74 on the inner diameter.

As shown in FIG. 2, a plurality of stepped rings 50 are placed in the cylindrical housing 10 so that the indicia 56 are visible through the window 18. The support of these stepped rings 50 is best shown in FIG. 4. The cylindrical support ring 30 on the end piece 14 fits into the circumferential groove 64 in the end 62 of stepped ring 50*a*. The connection between support ring 30 and groove 64 of stepped ring 50*a* is such as to allow stepped ring 50*a* to rotate, but still provide radial and axial support to stepped ring 50*a*. In an analogous manner, the third stepped portion 74 of stepped ring 50*g* fits in groove 22 in end piece 16 so that the stepped ring 50*g* is allowed to rotate, but is supported in the radial and axial directions.

A plurality of stepped rings 50 are nested to provide mutual support between the support ring 30 on end piece 14 and the groove 22 in end piece 16. This nesting roughly corresponds to the stacking of tapered cups, a portion of each cup extending into and supporting the immediately adjacent cup. The nesting is accomplished by having the third stepped portion 74 of one stepped ring 50 mate with the groove 64 in end 62 of the adjacent stepped ring 50. A number of stepped rings 50 can be nested in this manner, with the end two stepped rings 50*a* and 50*g*, mating with the groove 22 in end piece 16 and the support ring 30 in end piece 14, so as to provide support to each end of the nested rings 50.

In this nested manner, each moveable segment, or stepped ring 50 is directly or indirectly engaged and supported by the immediately adjacent ring 50 or support structure such as support ring 30 and groove 22. Viewed in another light, the nested step rings 50 become part of the support structure. This nesting is most readily accomplished if the rectangular grooves 64 and 22 are the same shape and can mate with support ring 30 and the third stepped portion 66. By implication the support ring 30 and third stepped ring 66 preferably have similar shapes. The embodiment shown in FIG. 4 uses seven stepped rings 50*a–g* in this nested configuration. Thus, there are seven stepped rings 50 having seven external surfaces, each of which preferably displays indicia 56 through window 18 of housing 10. Each of the stepped rings 50*a–g* can be independently rotated.

The engagement of the drive mechanism with the moveable segments is best seen in FIGS. 4 and 6. The stepped rings 50 engage with projections 48 on drive shaft 40. As shown in FIG. 6, the tip of projection 48 engages with engaging teeth 58 and fits within the slot 60 between teeth 58 on the inside of stepped ring 50. Rotation of drive shaft 40 by handle 44 causes rotation of projections 48 which in turn causes rotation of those stepped rings 50 which are engaged with the projections 48.

In order to allow the projections 48 to slide between the engaging teeth 58 on adjacent stepped rings 50, the engaging teeth 58 must be suitably aligned. Briefly described, the alignment is achieved when a resilient member is urged against one of a series of indexing members so as to incrementally position the indexing member with respect to the location of the resilient member. Each moveable segment contains the indexing members; thus, correct positioning of the resilient members and indexing members ensures uniform alignment of the moveable segments, and more importantly, alignment of the engaging members located on the moveable segments. The indexing members also maintain incremental alignment of any moveable segments which are not moving, by preventing inadvertent movement of the segments as could be caused by frictional contact with the adjacent sections.

FIGS. 5 and 6 show how this incremental alignment is achieved in the preferred embodiment. The alignment device or indexing device preferably takes the form of an index spring 80 which has two parallel engaging ribs 82. A plurality of substantially parallel index members 84 connect the engaging ribs 82. Each index member 84 is bent so that it has a notched portion 86 intermediate the two engaging ribs 82. Notched portion 86 is preferably equally spaced between the engaging ribs 82. There are preferably the same number of index members 84 as there are stepped rings 50 having indexing teeth 68 and indexing slots 70. The index spring 80 has an overall bend or curvature when installed so that it can fit between the stepped rings 50 and the cylindrical housing 10, and when so positioned, the engaging ribs 82 are connected to the cylindrical housing 10 to maintain the position of index spring 80. The position of index spring 80 is preferably achieved by placing engaging ribs 82 into slots 83 located in the cylindrical housing 10, although diverse fastening methods could be used, such as rivets, screws, glue or other common fasteners. The index spring 80 is positioned along the longitudinal axis of cylindrical housing 10 so that the notched portion 86 of the index member 84 is urged against, and releasably engages with, the second stepped portion 66, with the notched portion 86 being urged to rest against the indexing slots 70 on stepped ring 50 by the spring action of index spring 80.

As stepped rings 50 are engaged by projections 48 and rotated by handle 44, and drive shaft 40, the indexing teeth 68 drive the notched portion 86 up and out of the indexing slots 70 over the contacting indexing teeth 68 and into the adjacent indexing slot 70. Rotation of stepped ring 50 further bends various engaging ribs 84 on index spring 80 with the result that index spring 80 urges the stepped ring 50 to remain in position by urging the notched portion 86 to remain in one of the indexing slots 70. Thus there is advantageously provided a means of preventing inadvertent rotation of those stepped rings 50 which are not engaged and driven by the drive mechanism. This inhibition of unintentional rotation helps maintain alignment of the non-engaged rings 50. Additionally, the cooperation of index spring 80 and indexing teeth 68 urges the stepped rings 50 to rotate in increments corresponding to the spacing of index slots 70, resulting in incremental positioning of indicia 56 contained on the rings 50.

Referring to FIG. 6, the index spring 80 insures alignment of the engaging teeth 58 and slots 60 on the nested stepped rings 50 by having the notches 84 on index spring 80 engage the indexing slots 70 to align the indexing teeth 68 and indexing slots 70 on the nested step rings 50. Since the indexing teeth 68 and slots 70 are on the same stepped ring 50, geometrical alignment of the indexing slots 60 can readily enable alignment of the engaging members 58. Alignment of the slots 60 on adjacent, nested step rings 50 enables the projections 48 to slide between the slots 60 and disengage one ring 50, while engaging an adjacent ring 50. The projections 48 are slid between adjacent stepped rings 50 by axial movement drive shaft 40, although movement of the projections 48 on the shaft 40 is also possible. There is thus advantageously provided an easy way to insure alignment of the engaging members on the moveable segments so that at least one element of the drive mechanism can be axially translated to engage a different combination of moveable segments.

The number and width of projections 48, the width of engaging teeth 58 and slots 60, the space between adjacent slots 60 on adjacent stepped rings 50, and the width of annular grooves 42 in drive shaft 40, all cooperate to allow the drive mechanism to disengage one stepped ring 50 while engaging an adjacent ring 50. Conceptually stated, the width and spacing of the engaging portions of the drive mechanism do not all align with the engaging portions on the moveable segments so as to engage every moveable segment. Thus shifting the drive mechanism axially will cause different engaging portions on the drive mechanism to align and engage with a different subset or combination of moveable elements or segments so as to move different segments. Preferably, each subset or combination of elements contains at least one element which is also contained in at least one other subset or combination. These overlapping subsets increase the complexity of re-arranging the indicia by continually altering the existing positions of the indicia 56 which were previously positioned.

In the illustrated embodiment of FIG. 4, there are six projections 48*a–f* while there are seven stepped rings 50*a–g*. The projections 48*a–f* and stepped rings 50*a–g* are lettered consecutively from left to right as shown in FIG. 4. The spacing and size of the projections 48*a–f* are such that in the embodiment shown, not all stepped rings 50 are rotated simultaneously. The relative number of projections 48 and stepped rings 50 can be varied to provide the requisite degree of complexity or difficulty in aligning the indicia 56 on the stepped rings 50.

The width of projections 48*a, b, d* and *e* is slightly less than the space between adjacent grooves 42 on the drive shaft 40, which space is also the same as the space between adjacent engaging teeth 58 when the stepped rings 50 are nested. This space between adjacent teeth 58 on adjacent stepped rings 50 depends upon the axial length of the internal surface 72 and the axial length of engaging teeth 58. The inside diameter and length of the internal surface 72 is preferably of large enough diameter to prevent engagement with or binding on projections 48. Thus, the length of surface 72 is preferably slightly less than the width of the projections 48*a, b, d* and *e*. Hence when any of the projections 48*a, b, d* or *e* are positioned over an internal surface 72, these projections will not engage a stepped ring 50.

The axial length of engaging teeth 58*a, b, c, d,* and *g* on stepped rings 50 is approximately twice the width of projections 48*a, b, d* and *e*. Thus, drive shaft 40 must be moved a distance of one or more grooves 42 to disengage a projection 48*a, b, d* or *e*. Making a protection 48 twice the width as that of 48*a, b, d* or *e*, as is done with projections 48*c* and 48*f*, enables those double width projection 48*c* and 48*f* to always be engaged with one stepped ring 50 since the space between adjacent engaging teeth 58*a, b, c, d, f* and *g*, in the nested stepped rings 50, is only half the width of the double width projections 48*c* and 48*f*. That space is represented by the axial length of internal surface 72.

Increasing the width of projections 48 further could enable simultaneous engagement of a number of stepped rings 50. Simultaneous engagement could also be provided by decreasing the space between adjacent engaging members 58, by either shortening the length of internal surface 72, by increasing axial length of engaging teeth 58, or by extending engaging teeth 58 onto surface 72. Conversely, the axial length of engaging teeth 58 can be decreased, as was done with engaging teeth 58*e* and *f*, which are one half the length of the other engaging teeth 58. Decreasing the engagement length of the engaging teeth 58 can decrease the number of positions in which the rings 50 will be engaged and rotated by a projection 48.

Thus, one advantage of this invention is that it uses driving and driven members having differing engaging members of differing widths or engageable lengths so that only a portion of at least one member is engaged. Thus the repositioning, preferably by axial translation, of one of those members will cause various combinations of the members to engage, disengage, or simultaneously engage by shifting the engagement of the members to a different engageable portion of the member having the greater length.

Referring to FIG. 7, it was previously mentioned that the drive shaft 40 can be axially translated by applying sufficient axial force to cause rounded rib 28 to release the engaged annular groove 42 and shift to a different groove 42. In the illustrated embodiment of FIG. 7, the axial length of the engaging teeth 58*a, b, c, d* and *g*, and slots 60, are twice the width of all of the projections 48 except for the third and sixth projections, 48*c*, and 48*f*, counting from left to right. The axial length of engaging teeth 58*e* and *f* are the same as the width of the projections 48*a, b, d*, and *e*. The width and spacing of annular grooves 42 is such that shifting the distance of one axial groove 42 will cause the drive shaft 40 to translate or shift axially by the width of one of the projections 48*a, b, d* or *e*. The nesting of the stepped rings 50 and the axial length of the internal surface 72, which preferably lacks the teeth 48 and slots 60, is such as to provide a space slightly larger than the width of the projections 48*a, b, d* and *e*, so that these projections will not engage a stepped ring 50 when these projections are positioned over the space formed by surface 72. Thus, the standard projections 48*a, b, d* and *e*, will be engaged for two of the three incremental translations of drive shaft 40. The third and fifth projections 48*c* and *f*, are twice the width of the projections 48*a, b, d* and *e*, and thus, the double width projections 48*c*, and *f* will engage a stepped ring 50 in every incremental position of annular groove 42. There is thus advantageously provided a means of varying the drive mechanism engagement with various subsets or combinations of the moveable sections, merely by shifting one element in the drive mechanism.

The operation of the illustrated embodiment of this invention is best seen by referring to FIGS. 7–9. The initial position corresponds to the drive shaft 40 being in the left-most position so that rounded rib 28 engages the right-most, or third annular groove 42, again counting from left to right. Referring first to FIG. 7, and counting and lettering from left to right, the first projection 48*a* engages the left-most or first half of engaging teeth 58*a* on the first stepped ring 50*a*. The second projection 48*b* engages the right half, or second half of engaging teeth 58*b* on the second stepped ring 50*b*. The third projection is a double width projection 48*c* which engages the second half of the engaging teeth 58*c* on the third stepped ring 50*c*. The right half of double width projection 48*c* occupies the space between engaging teeth 58*c* and 58*d* on adjacent stepped rings 50*c* and *d*, which space is made by internal surface 72. The fourth stepped ring 50*d* is not engaged by a projection 48 in the initial position of drive shaft 40. The fourth projection 48*d* engages nothing since the first half of the fifth stepped ring 50*e* is missing. The fifth projection 48*e* is not engaged as it is in the space between engaging teeth 58*e* and 58*f*. The engaging teeth 58*f* of sixth stepped ring 50*f* are not engaged by a projection 48. The second half of sixth double width projection 48*f* engages the first half of the engaging teeth 58*g* of the seventh stepped ring 50*g*. with the first half of the projection 48*f* occupying the space left by internal surface 72, which space separates the engaging teeth 58 on adjacent stepped rings 50*f* and *g*.

As shown in FIG. 4 and as described above, rotation of handle 44 causes rotation of drive shaft 40 and projections 48 which rotate the engaged stepped rings 50 so as to cause the first, second, third, and seventh rings 50*a, b, c*, and *g*, to rotate. The fourth and fifth projections 48*d* and 48*e* are not engaged with a stepped ring 50, but are located in the unslotted spaces between the fifth, sixth and seventh stepped rings 50*e, f* and *g*, which spaces are left by internal surface 72.

Pulling on handle 44, by hand, is sufficient to reposition or move drive shaft 40 from the third annular groove 42 into the second groove 42. This repositioning changes the engagement between the projections 48 and the stepped rings 50. This second position is shown in FIG. 8. Stepped rings 50*a, d, e*, and *g* will be rotated when rounded rib 28 is in the second annular groove 42 on drive shaft 40. The projection 48*a* engages the second half of the stepped ring 50*a*. Annular projection 48*b* is in the space between the stepped rings 50*b* and *c* and does not rotate a ring 50. The double width projection 48*c* engages the first half of stepped ring 50*d*. Projection 48*d* engages stepped ring 50*e*. Projection 48*e* does not engage the stepped ring 50*f* since the left half of stepped ring 50*f* is missing. The double width projection 48*f* engages the first and second halves of the stepped ring 50*g*. In this position, the stepped rings 50*a* and 50*g* are common to, or overlap with, the previous combination or subset of positionable elements or segments as shown in FIG. 8.

Referring now to FIG. 9, when the rounded rib 28 is in left most, or the first annular groove 42, again lettering and counting from left to right, the stepped rings 50*c, d, f* and *g* will be rotated. The first annular projection 48*a* is in the space between the stepped rings 50*a* and *b*, so the projection 48*a* is thus, not engaged. Projection 48*b* engages the first half of the engaging teeth 58*c* on stepped ring 50*c*. The double width projection 48*c* engages both halves of the stepped ring 50*d*. The projection 48*d* is in the space between the stepped rings 50*e* and *f*, and is thus not engaged. The projection 48*e* engages the stepped ring 50*f*. The double width projection 48*f* engages the second half of stepped ring 50*g*.

In operation, a non-uniform positioning of the rings 50 and indicia 56 occurs when the projections 48 are rotated, with an axial repositioning of the projections 48 occurring between rotations. For example, in the preferred embodiment as illustrated in FIGS. 4 and 7–9, the arrangement of the indicia 56 might be altered by rotating the projections 48 one notch clockwise with the drive shaft 40 in the right-most, or first annular groove 42, repositioning the drive shaft 40 to the second groove 42 and rotating the projections 48 two notches counter-clockwise, followed by a repositioning of the drive shaft 40 into the left most or third annular groove 42 with a subsequent rotation of the projections 48 by one notch in the clockwise direction. With this exemplary manipulation the projections 48 have been returned to their initial position, having been rotated equal amounts clockwise and counter-clockwise. The arrangement of the indicia on the annular rings 50 has been altered as follows: stepped rings 50*a, b, c, e* and *h* rotated one notch clockwise during the first manipulation; stepped rings 50*a, d, e, f* and *g* were rotated two notches counter-clockwise during the second manipulation; and stepped rings 50*c, d, f*, and *g* were rotated one step clockwise during the third and final manipulation. Thus, in this example, the final positions of stepped ring 50*b* is one notch clockwise; stepped ring *c* is two notches clockwise, while stepped rings 50*a, d, e, f* and *g* have rotated one notch counterclockwise.

In an alternate embodiment, illustrated in FIG. 10 one or more stepped rings 50 are limited to undirectional travel by conventional pawl and ratchet mechanism.

Such a pawl mechanism typically consists of a pawl 90 which has a pivoted lever or tongue 91 having an inclined head 92 on the end thereof which is resiliently urged into recesses or notches 94 on the member whose travel is to be limited. The head 92 has inclined surface 93 which cooperates with a corresponding inclined surface 95 on the notch 94 to provide an inclined or ramped surface which allows the head 92 to ramp up the inclined surfaces 93 and 95 to disengage the notches 94 when the relative motion between the parts is in one direction. There are corresponding hooked or engaging portions 97 and 99 on the head 93 on the notch 94, respectively, which engage or catch as to prevent motion when the relative motion between parts is in the opposite direction. The notched portion 86 of index spring 80 could be shaped to serve the function of the pawl mechanism.

Limiting one engaged moveable segment to unidirectional travel will limit movement of all engaged segments unless the segments are connected to separate drives or drive mechanisms, or unless the particular drive element engaging with the unidirectionally limited section can rotate without moving the engaged segment. Suitable undirectional drive elements are shown in FIG. 10, wherein the drive tip 96 is pivoted on the end of projection 48 such that stop 98 allows the drive tip 96 to pivot in only one direction, the drive tip 96 being resiliently urged against the stop 98 by torsion spring 100. Thus, the drive tip 96 would rotate out of the engaging teeth 58 in stepped ring 50 so as not to engage the stepped ring 50 when the rotational direction coincided with the direction in which motion is inhibited by the pawl mechanism. When the projection 48 and drive tip 96 are rotated in the opposite direction, the stop 98 would prevent the drive tip 96 from rotating out of the way so that the stepped ring 50 would be driven in that direction.

A similar effect could be achieved by using a conventional one way ratchet mechanism located at the mounting of projection 48 on drive shaft 40. Alternately, the pawl mechanism could be eliminated if the rotational force exerted by torsion spring 100 on tip 96 is insufficient to overcome the restraining force exerted by the index spring 80, which spring 80 seeks to prevent inadvertent rotation of stepped rings 50. In essence, the stop 98 would cause the tip 96 to transmit motion in one direction, but the spring 100 would not be strong enough to transmit motion in the opposite direction.

Shown in FIGS. 3 and 6 is an additional feature of this invention which enables an additional amount of variability to be introduced into the manipulation of stepped rings 50. Summarily described, one or more of members or engaging teeth 58, which normally engage the tip of projection 48, are omitted so that the stepped ring 50 having the missing teeth 58 intermittently fails to be engaged and rotated by projection 48. The projections 48 are slid between slots 60 and engaging members 58 on adjacent stepped rings 50. If the engaging members 58 are intermittently spaced, and if projections 48 are slid into one of the intermittent locations lacking engaging members 58, then the projections 48 cannot immediately engage and drive the stepped ring 50.

Referring to FIGS. 3 and 6, there is shown a gap 59 between engaging members 58, the gap 59 extending the full axial length of engaging members 58. As shown in FIG. 6, the gap 59 is formed by omitting or removing two engaging members 58, although the size of the gap 59 can be varied. When the projection 48 is slid into the end of gap 59, as shown in phantom, the projection 48 will contact engaging member 58 if the projection 48 is rotated clockwise, so as to rotate the engaged stepped ring 50. When rotated in the counter-clockwise direction, however, the projection 48 does not immediately contact an engaging member 58 so that the stepped ring 50 is not rotated, but is held in position by index member 80. After the projection 48 rotates two intervals, as determined by the spacing of indexing slots 70, the projection 48 again contacts an engaging member 58 as to be able to transmit counter-clockwise motion to the engaged ring 50. At this point, however, clockwise rotation of projection 48 would not cause rotation of the stepped ring 50 since there is no engaging member 58 to be immediately contacted as to transmit motion. The nearest engaging member 58 in the clockwise direction is at the other end of gap 59.

The width of the projection 48 and the engaging teeth 58 can vary. Thus, it is possible to delete or omit only a portion of the width or length of teeth 58, as shown in FIGS. 3 and 6. As shown in in FIGS. 3 and 6, gap 61 has two engaging members 58 omitted or removed, but only for half of the axial length of the engaging members 58. Since the projection 48 engages the stepped ring 50 at two diametrically opposing points, the engaging teeth 58 must be removed from two spots at dimetrically opposite locations. The number and location of the engaging teeth 58 which are removed thus depends upon the number and orientation of projections 48. There is thus advantageously provided a means of selectively increasing the complexity and difficulty in aligning the indicia 56.

The preferred embodiment shows the use of stepped rings 50 to bear the indicia 56 and connect with the drive shaft 40. It is not necessary that rings be used since the drive mechanism as shown in the preferred embodiment could be applied to a rack gear, which in essence would be equivalent to cutting and flattening stepped rings 50. The projections 48, which are in essence a two-toothed gear, would assume the shape of more conventional pinion gearing, but the concept remains similar.

Figure 11:
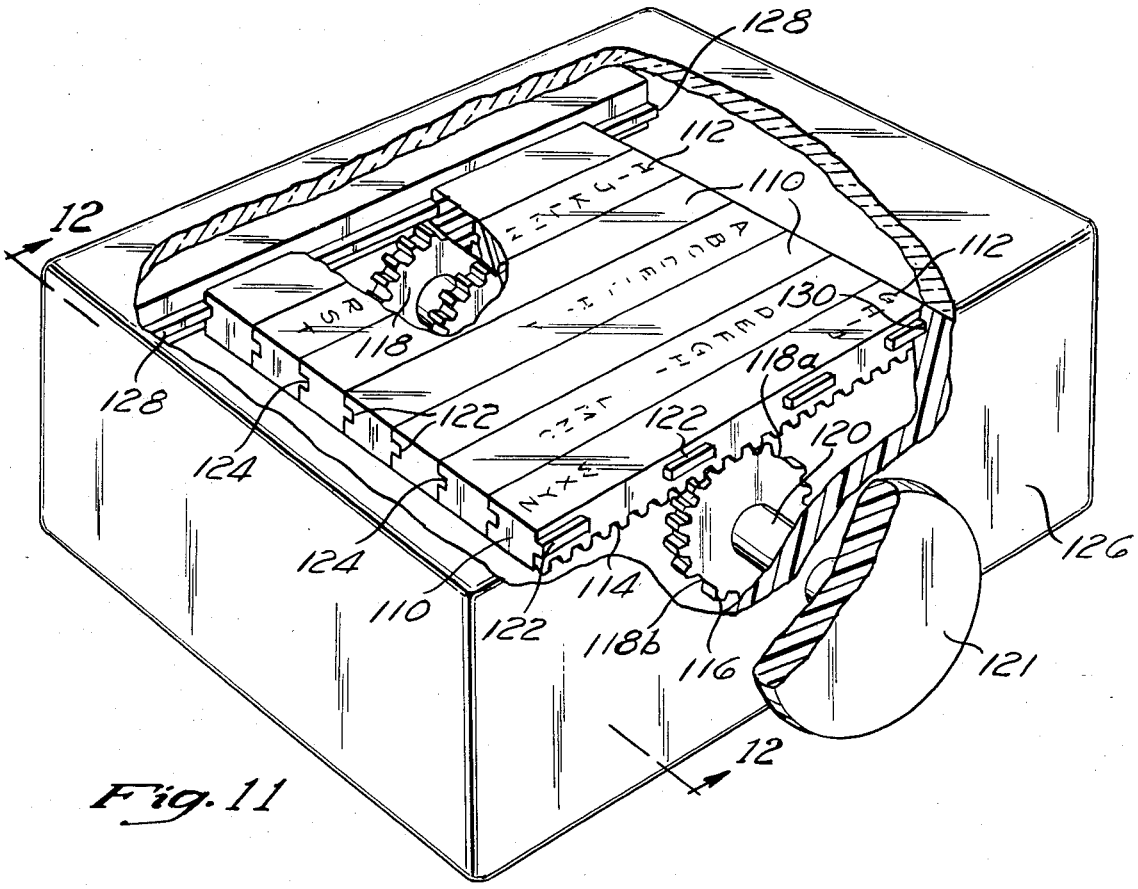
FIG. 11 is a partially cut away perspective illustration of a rack and pinion alternative embodiment of this invention.
Figure 12:
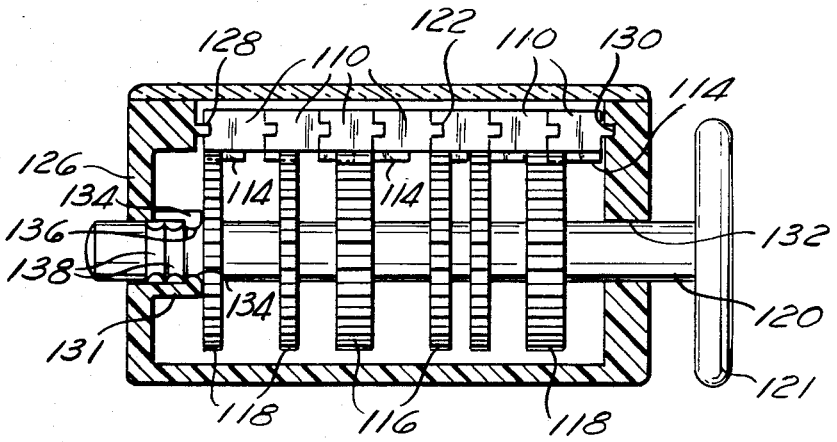
FIG. 12 is a partial cross-sectional view taken along 12—12 of FIG. 11.

A rack and pinion embodiment is illustrated in FIGS. 11 and 12. A plurality of driven, positionable elements or rach gears 110 have a surface on which indicia 112 are selectively visible in a manner analogous to that of the preferred embodiment. There are engaging members, or rack gear teeth 114 on the rack gears 110. The rack gear teeth 114 engage with teeth 116 on driving elements, such as pinion gear 118. Pinion gear 118 is mounted on a repositionable drive shaft 120, so that axial translation of shaft 120 and pinion gears 118 can cause the pinion gears 118 to engage a different combination of rack gears 110, in a manner analogous to that in the preferred embodiment.

The rack gears 110 are supported so as to allow independent movement of each gear 110. In the illustrated alternate embodiment, the rack gears 110 are neated in a manner similar to that of the preferred embodiment. Support projections 122 are located on one surface of the rack gear 110. The support projections 122 are rectangular projections, continuously, or preferably, intermittently spaced along the rack gear 110. Mating rectangular shaped support recesses 124 are located in the rack gear 110, the recesses being shaped to mate with the support projection 122 of the adjacent rack gear 110 much like a tongue in groove connection. The connection, however, allows the rack gears 110 to move independently of one another.

A support housing, or frame 126 supports the nested rack gears 110. A mating projection 128 on the frame 126 mates with the support recess 124 in the rack gear 110 to support the nested gears 110. A mating recess 130 on the frame 126 mates with the support projections 122 on the rack gear 110 to support the gears 110. Thus, the nested rack gears 110 are supported by the frame 126.

There is a hole 132 in one side of the frame 126 through which one end of drive shaft 120 extends. A handle 121 is fastened to the end of drive shaft 120 to rotate the shaft 120. The drive shaft 120 is rotatably supported by frame 126. The other end of drive shaft 120 is rotatably supported by cylindrical flange 131 which has a radially inward protruding rib 134 which defines a hole 136 through which the drive shaft 120 extends.

There are annular grooves 138 on the end of drive shaft 120 which engage the rib 134 so that sufficient axial force on the shaft 120 causes the ribs 134 to shift into the adjacent groove 138 and thereby allow the shaft 120 to translate in inrements corresponding to the distance between adjacent grooves 138. Thus the repositioning of drive shaft 120 allows the pinion gears 118 to engage a different subset or combination of rack gears 110 and cause rearrangement or repositioning of the indicia 112 on those gears 110 such that the indicia 112 on a specific portion of each gear 110 in predetermined combination of gears, can be perceived.

The functional operation of the alternate embodiment is the same as that of the preferred embodiment and will not be repeated here. The housing 126 of the alternate embodiment must be sufficiently long to allow movement of the rack gears 110 without the gears 110 being jammed against the housing 126. Alternately, a ratchet device could be installed on the pinion gears 118 so that the pinion gears 118 could still rotate once the rack gears 110 had been driven against the housing 126. The use of these ratchet mechanisms could provide an initializing mechanism to allow all of the rack gears 110 to be placed into an initial position with respect to one another.

The use of planar moving segments such as a lineraly moving rack and pinion combination, instead of the rotational combination of the preferred embodiment, allows the use of missing teeth on the pinion gears 118 in order to cause intermittent motion of the driven member. The missing teeth simulate a sector gear which provides for intermittent engagement. FIG. 11 illustrates a pinion gear 118 with missing teeth at two locations, 118*a* and *b*.

The rack gears 110 need not be linear, but could equally well be concentric planar gears. In the planar configuration, the rack gears 110 would be curved rings, lying in a plane, somewhat akin to a phonograph record. The planar configuration has the potential of allowing even greater flexibility in the location of the indicia 56 since more indicia 56 could be placed upon the larger diameter rings than on the smaller diameter, interior rings.

Yet another alternate embodiment of this invention is suitable for actuating a locking mechanism. In this embodiment, the depth of the engaging portions, such as the recesses or grooves 70 or the engaging teeth 68 (FIG. 3) is varied so that the different engaging portions can engage a lock mechanism in a lock in order to activate the lock. Lock mechanisms, such as tumbler mechanisms and the engagement of those mechanisms with engaging portions of variable depth or height is well known in the art and is not described herein.

Figure 13:
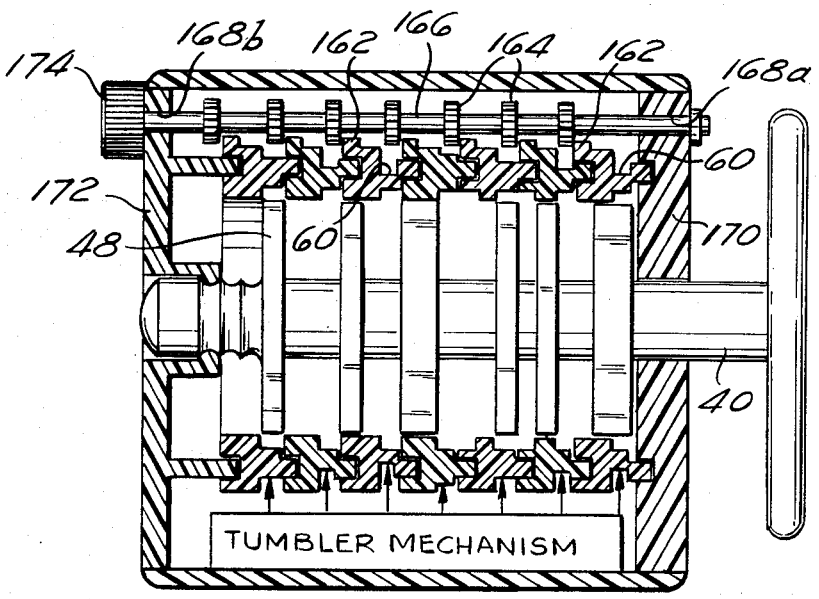
FIG. 13 is a cross-sectional view of an alternate embodiment of this invention activating a lock mechanism.

The manipulation of the device of this invention to achieve an operative location to actuate the lock mechanism is preferably achieved by starting from an initialized or zeroed position in which the projections 48 and the rings 50 are all pre-aligned at a starting position. FIG. 13 illutrates one application of this invention to a locking mechanism, and the initializing device. This initializing can be achieved by placing projection or stop 162 on each of the stepped rings 50. The stops 162 are preferably placed on the radially outward side of the first stepped portion 52 of stepped ring 50 (FIG. 3). The stop 162 aligns the rings 50 by abutting against corresponding initializing stop 164 which prevent the rings 50 from rotating once the stops 162 have contacted the initializing stops 164.

Referring to FIG. 13, a plurality of initializing stops 164 are placed on an initializing shaft 166 which is supported through apertures 168*a* and *b* located in end pieces 170 and 172. A knob or handle 174 is placed on one end of the shaft 166. The shaft 166 can be slidably or rotatably mounted in the end pieces 170 and 172. Axial or rotational repositioning of the shaft 166, by using knob 174, allows the initializing stops 164 to be positioned in the rotational path of stops 162 on rings 50 in order to initialize the device.

When the initializing stops 164 are placed into the path of stops 162 on rings 50, the stops 162 will contact the initializing stops 164 and bring the rings 50 to rest. The projections 48 continue to rotate after the ring 50 has come to rest. This can be achieved by various means such as the pivoted tip 96 as shown in FIG. 10. A bidirectional rotation of projection 48 on a stationary ring 50 could also be obtained by using a suitably dimensioned cantilever projection which would act as a leaf spring. The leaf spring having sufficient stiffness to move the rings 50 in normal operation, but also having sufficient flexibility to bend and continue rotating, without breaking, when the ring 50 was stopped as by contact between the stops 162 and the initializing stops 164.

In order to initialize the position of each of the rings 50, the shaft 40 must be shifted to each of its three positions and the rings in each position initialized. Once each of the rings is in the initialized position, then the initializing shaft 166 can be shafted so that the initializing stops 164 no longer restrain the rings 50. Then the device can be manipulated by the shaft 40 and projections 48 so that the slots 160 and engaging teeth 158 achieve an operative location and activate the tumblers on a lock mechanism.

I claim:

1. A manually manipulated mechanical device comprising:

a plurality of mutually positionable elements supported so that the elements are movable;

a drive selectably engaging and positioning different subsets of elements, at least one subset including at least one element in common with at least one other subset, the subsets being positioned to achieve an operative location of the elements by positioning an incremental part of each element in a predetermined combination with the similar incremental parts of other elements, so that the incremental parts are in a predetermined mutual relationship, wherein the elements comprise: driven members having engageable members for engaging the drive; and wherein the drive comprises a plurality of driving members, a plurality of which are engaged with the driven members along an engageable portion, the relative extents of the engageable portions of the driving members and on the driven members being sufficiently different so that the driving and driven members can be relatively repositioned to engage at least one different subset of said driven members.

2. A device as defined in claim 1, wherein the incremental parts on at least one element comprise indicia which can be sensed when in the operative location.

3. A device as defined in claim 1, wherein said driving members are in the form of a plurality of gears, each having at least one tooth, and said drive comprises at least one input drive member transmitting motion to said plurality of gears.

4. A device as defined in claim 1, wherein the drive comprises:

at least one input drive member having a rotational and translational support to allow translation movement of the input drive member so that the member can be translated sufficiently to engage a plurality of the subsets of driven members.

5. A device as defined in claim 4, further comprising:

a plurality of projections connected to the input drive member, at least one projection engaging at least one element to transmit motion from the input drive member to the drive member.

6. A device as defined in claim 1, further comprising:

randomizing means for enabling intermittent motion of at least one of the driven members by causing intermittent engagement of the drive with at least one driven member.

7. A device as defined in claim 1, further comprising:

indexing means for resisting inadvertent movement of the driven members, and for aligning the drive to facilitate engagement of the driving members with said plurality of subsets.

8. A device as defined in claim 1, wherein the driven members move in substantially the same plane.

9. A device as defined in claim 1 further comprising:

undirectional movement limiting means for at least temporarily limiting the direction of movement of at least one driven member to movement in one direction.

10. A device as defined in claim 1, further comprising:

initializing means for positioning the mutually positionable elements in a repeatable, starting position.

11. A method of manual manipulation to reposition the elements of a mechanism, comprising:

selectively engaging a drive with one subset of a set of engaged, mutually positionable elements, manipulating the drive to position said one subset of elements;

engaging the drive with at least one different subset of said set, said one different subset and said one subset including at least one common element from said set;

manipulating the drive to position said one different subset of elements;

repeating the previously defined steps to achieve an operative mutual relationship among those incremental portions of said elements, wherein the repeating step comprises axially repositioning a drive member in the drive so that at least one projection on the drive member disengages said one subset, and engages said one different subset of said subsets of elements.

12. A method as defined in claim 11, further comprising:

sensing the operative location of the incremental portion of said elements.

13. A method as defined in claim 11 wherein an additional first step comprises:

intializing the position of the elements to a repeatable starting position.

14. A manually manipulated puzzle device comprising:

plurality of independently rotatable, juxtaposed rings having indicia thereon and having engaging members on the rings;

a drive member having a plurality of projections which engage and rotate various combinations of rings through contact with the engaging members on the engaged rings, at least one of the various combinations containing at least one ring common to another of said combinations, the drive member being re-positionable so as to engage the projections with another of said combinations of the engaging members to rotate a different combination of rings in order to allow positioning of the indicia of plural rings in a cooperative location.

15. A device as defined in claim 14, further comprising:

a plurality of indexing portions spaced about each ring at regular intervals;

at least one detent member urged against and engaging the indexing portions, the detent member inhibiting inadvertent rotation of the engaged rings and urging the rings to align the engaging members with the projections to facilitate repositioning of the drive member and engagement of another combination of engaging members by the repositioned projections.

16. A device as defined in claim 14 wherein the engaging members are intermittently spaced on at least one ring so that the projections on an engaged drive member intermittently engage with the engaging members on that ring to intermittently rotate that ring.

17. A manually manipulated mechanical device comprising:

a plurality of mutually positionable elements supported so that the elements are moveable;

a drive selectably engaging and positioning different subsets of elements, at least one subset including at least one element in common with at least one other subset, the subsets being positioned to achieve an operative location of the elements by positioning an incremental part of each element in a predetermined combination with the similar incremental parts of other elements, so that the incremental parts are in a predetermined mutual relationship; and randomizing means for enabling intermittent motion of at least one of the mutually positionable elements by causing intermittent engagement of the drive with at least one element.

* * * * *